US010958045B2

(12) United States Patent
Sumoyama et al.

(10) Patent No.: US 10,958,045 B2
(45) Date of Patent: Mar. 23, 2021

(54) SPARK PLUG

(71) Applicant: NGK Spark Plug Co., Ltd., Nagoya (JP)

(72) Inventors: Daisuke Sumoyama, Nagoya (JP); Kazuki Ito, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 16/965,752

(22) PCT Filed: Sep. 3, 2019

(86) PCT No.: PCT/JP2019/034509

§ 371 (c)(1),
(2) Date: Jul. 29, 2020

(87) PCT Pub. No.: WO2020/095526

PCT Pub. Date: May 14, 2020

(65) Prior Publication Data

US 2021/0036492 A1 Feb. 4, 2021

(30) Foreign Application Priority Data

Nov. 9, 2018 (JP) ..... JP2018-211068

(51) Int. Cl.
*H01T 13/39* (2006.01)
*C22C 5/04* (2006.01)
*C22C 19/05* (2006.01)

(52) U.S. Cl.
CPC ..... *H01T 13/39* (2013.01); *C22C 5/04* (2013.01); *C22C 19/05* (2013.01)

(58) Field of Classification Search
CPC ..... H01T 13/39; C22C 5/04; C22C 19/05
USPC ..... 313/142
See application file for complete search history.

(56) References Cited

U.S. PATENT DOCUMENTS

| | | | | |
|---|---|---|---|---|
| 10,033,163 | B1 * | 7/2018 | Sumoyama | C22C 5/04 |
| 2016/0294164 | A1 * | 10/2016 | Sumoyama | C22C 5/04 |
| 2018/0369919 | A1 * | 12/2018 | Burkhardt | B22F 1/0014 |
| 2020/0259315 | A1 * | 8/2020 | Abe | C22C 5/04 |

FOREIGN PATENT DOCUMENTS

| | | | |
|---|---|---|---|
| JP | 2003-105467 | A | 4/2003 |
| JP | 2007-173116 | A | 7/2007 |

OTHER PUBLICATIONS

International Search Report from corresponding International Patent Application No. PCT/JP2019/034509, dated Nov. 19, 2019.

* cited by examiner

*Primary Examiner* — Christopher M Raabe
(74) *Attorney, Agent, or Firm* — Kusner & Jaffe

(57) ABSTRACT

In a spark plug, a base material contains 50 mass % or more of Ni, 8 mass % or more and 40 mass % or less of Cr, 0.01 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 5 mass % or less of Fe. A discharge member contains at least Pt of a P group (Pt, Rh, Ir, and Ru) and Ni. The atomic concentration K of the P group of the discharge member, the atomic concentration L of the P group of the base material, the atomic concentration M of Ni of the discharge member, and the atomic concentration N of Ni of the base material satisfy $(K+L)/(M+N) \leq 1.14$.

8 Claims, 5 Drawing Sheets

SPARK PLUG

FIELD OF THE INVENTION

The present invention relates to a spark plug and relates, in particular, to a spark plug in which at least a portion of a discharge member is bonded to a base material with a diffusion layer interposed therebetween.

BACKGROUND OF THE INVENTION

As a result of increased performance, improved combustion efficiency, and the like of engines, the temperature of electrodes of spark plugs under usage environment tends to become high. In a spark plug in which a first electrode including a discharge member bonded to a base material faces a second electrode with a spark gap interposed therebetween, an increase in the temperature of the first electrode increases a thermal stress of a bonded part of the discharge member, and there is thus a concern of peel-off of the discharge member. Here, in the technology disclosed in Japanese Unexamined Patent Application Publication No. 2003-105467 ("PTL 1"), a base material contains 0.05 mass % or more and 5 mass % or less of Fe to thereby improve high-temperature strength and high-temperature corrosion resistance, thereby suppressing peel-off of a discharge member. In an example in Japanese Unexamined Patent Application Publication No. 2007-173116 ("PTL 2"), a base material contains 2 mass % of Fe to ensure the high-temperature strength of the base material, thereby suppressing peel-off of a discharge member.

The discharge members in the examples in PTL 1 and PTL 2 each constituted by a Pt—Ir alloy mainly constituted by Pt and containing Ir. Incidentally, a discharge member constituted by a Pt—Ni alloy mainly constituted by Pt and containing Ni is also known. Discharge members constituted by a Pt—Ni alloy are superior to discharge members constituted by a Pt—Ir alloy in wear resistance and peeling resistance.

As a result of earnest examination on an electrode in which a discharge member constituted by a Pt—Ni alloy is bonded to a base material containing Fe, it was found that there was a possibility of the wear resistance and the peeling resistance of the discharge member being not sufficiently ensured under a further temperature increase of the electrode. In other words, due to the discharge member containing Ni, Fe derived from the base material easily diffuses in the discharge member under usage environment. Fe naturally has a property of decreasing the melting point of a Pt alloy, and there is thus a possibility that the discharge member is easily worn out.

Further, when the Fe diffusing in the discharge member combines with Pt of the discharge member and generates an intermetallic compound at a bonded part between the discharge member and the base material, the bonded part becomes brittle. Moreover, generation of the intermetallic compound causes a volume change, which increases the stress of the bonded part between the discharge member and the base material. Consequently, there is a possibility of the discharge member easily peeling off. In particular, compared with an electrode in which a discharge member is bonded to a base material with a laser-welded fused portion interposed therebetween, the electrode in which at least a portion of the discharge member is bonded to the base material with the diffusion layer interposed therebetween is poor in stress buffering effect exerted by the diffusion layer. The discharge member thus has a possibility of more easily peeling off.

SUMMARY OF THE INVENTION

The present invention has been made to solve the above-mentioned problem, and an object thereof is to provide a spark plug capable of suppressing peel-off and worn-out of a discharge member bonded to a base material.

Solution to Problem

To achieve the object, a spark plug according to the present invention includes: a first electrode including a base material and a discharge member having at least a portion thereof bonded to the base material with a diffusion layer interposed therebetween; and a second electrode facing the discharge member with a spark gap interposed therebetween. The base material contains 50 mass % or more of Ni, 8 mass % or more and 40 mass % or less of Cr, 0.01 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 5 mass % or less of Fe. The discharge member is an alloy containing Pt most and containing Ni or the alloy further containing at least one of Rh, Ir, and Ru. When Pt, Rh, Ir, and Ru are considered as a P group, K (at %) represents an atomic concentration of the P group of the discharge member, L (at %) represents an atomic concentration of the P group of the base material, M (at %) represents an atomic concentration of Ni of the discharge member, and N (at %) represents an atomic concentration of Ni of the base material, $(K+L)/(M+N) \leq 1.14$ is satisfied.

Advantageous Effects of Invention

According to the spark plug described in a first aspect, the base material contains 0.001 mass % or more and 5 mass % or less of Fe and contains 0.01 mass % or more and 2 mass % or less of Si. Such a composition causes Si diffusing in the discharge member to accelerate diffusion of Fe diffusing in the discharge member. It is thus possible to cause Fe to easily reach the surface of the discharge member. The Fe that has reached the surface of the discharge member is oxidized and easily disappears from the surface of the discharge member, which can avoid an increase of the content ratio of Fe in an inner portion of the discharge member. Therefore, it is possible to suppress the melting point of the discharge member from decreasing and suppress the discharge member from being worn out.

The atomic concentration K of the P group of the discharge member, the atomic concentration L of the P group of the base material, the atomic concentration M of Ni of the discharge member, and the atomic concentration N of Ni of the base material satisfy $(K+L)/(M+N) \leq 1.14$. The relatively high atomic concentration of Ni causes the Fe diffusing in the discharge member and the atoms of the P group contained in the discharge member not to easily react relatively. It is possible to suppress the diffusion layer and the interface between the diffusion layer and the discharge member from becoming brittle because Fe and the atoms of the P group contained in the discharge member can be suppressed from generating an intermetallic compound. It is also possible to suppress a thermal stress of the interface between the diffusion layer and the discharge member, which can suppress the discharge member bonded to the base material from peeling off.

According to the spark plug described in a second aspect, the base material and the discharge member satisfy (K+L)/(M+N)≤0.82. It is thus possible to further suppress the discharge member from peeling off.

According to the spark plug described in third and fourth aspects, when X (mass %) represents a content ratio of Si of the base material, and Y (mass %) represents a content ratio of Fe of the base material, X/Y≥0.04 is satisfied. Such a composition causes the Si diffusing in the discharge member to further accelerate diffusion of the Fe diffusing in the discharge member. It is thus possible to cause the Fe to more easily reach the surface of the discharge member. Therefore, in addition to the effect the first aspect or the second aspect, it is possible to further suppress the discharge member from being worn out.

According to the spark plug described in a fifth aspect, when X (mass %) represents a content ratio of Si of the base material, and Y (mass %) represents a content ratio of Fe of the base material, X/Y≥0.35 is satisfied. It is thus possible to further suppress the discharge member from being worn out.

According to the spark plug described in a sixth aspect, the base material contains 0.001 mass % or more and 2 mass % or less of Fe. It is thus possible to reduce the influence of Fe on the decrease of the melting point of the discharge member and on the embrittlement of the interface. Therefore, in addition to any of the effects of the first to fifth aspects, it is possible to further suppress the discharge member from peeling off.

According to the spark plug described in a seventh aspect, the base material contains 22 mass % or more and 28 mass % or less of Cr, 0.7 mass % or more and 1.3 mass % or less of Si, 0.6 mass % or more and 1.2 mass % or less of Al, 0.1 mass % or more and 1.1 mass % or less of Mn, 0.01 mass % or more and 0.07 mass % or less of C, and 0.001 mass % or more and 2 mass % or less of Fe. Therefore, in addition to any of the effects of the first to sixth aspects, it is possible to further avoid the discharge member from easily peeling off.

According to the spark plug described in an eighth aspect, the base material includes a solid solution containing Ni, the solid solution including a segregate present therein, and, in a cross-section of the base material, an area of the segregate occupying an area of the base material is 0.01% or more and 4% or less. Consequently, it is possible to ensure the high-temperature strength of the base material. Thus, in addition to any of the effects of the first to seventh aspects, it is possible to further avoid the discharge member from easily peeling off.

DETAILED DESCRIPTION OF THE INVENTION

Figure 1:
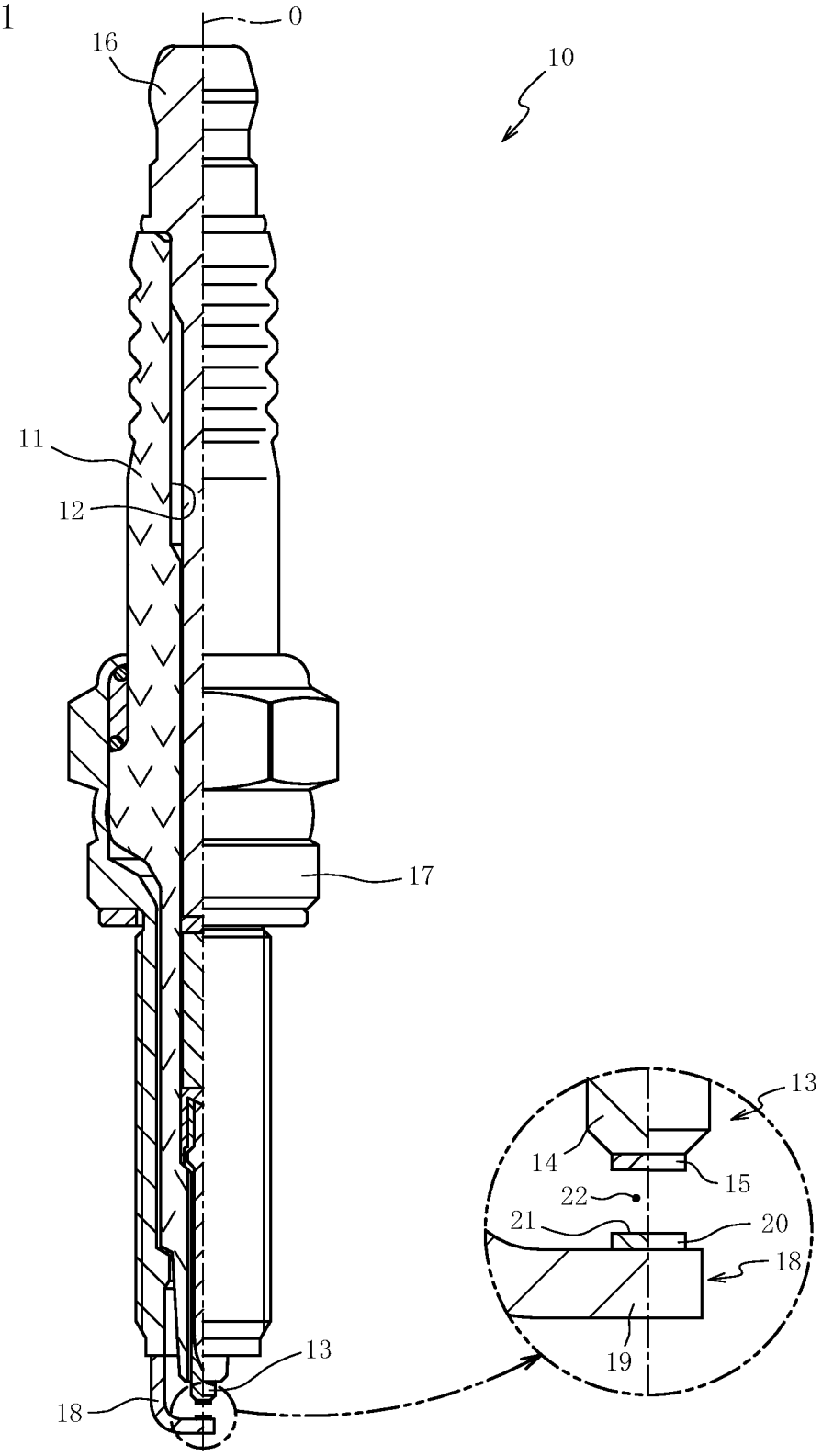
FIG. 1 is a half sectional view of a spark plug according to an embodiment.

Hereinafter, a preferable embodiment of the present invention will be described with reference to the attached drawings. FIG. 1 is a half sectional view of a spark plug 10 according to an embodiment with an axis O as the boundary. The lower side of FIG. 1 is referred to as the front-end side of the spark plug 10, and the upper side of FIG. 1 is referred to as the rear end side of the spark plug 10 (the same applies to FIG. 2).

As illustrated in FIG. 1, the spark plug 10 includes an insulator 11, a center electrode 13 (second electrode), a metal shell 17, and a ground electrode 18 (first electrode). The insulator 11 is a substantially cylindrical member excellent in mechanical characteristics and insulation properties under high temperatures and formed of alumina or the like. The insulator 11 has an axial hole 12 extending therethrough along the axis O.

The center electrode 13 is a bar-shaped electrode inserted into the axial hole 12 and held along the axis O by the insulator 11. The center electrode 13 includes a base material 14 and a discharge member 15 bonded to the front end of the base material 14. In the base material 14, a core material having excellent thermal conductivity is embedded. The base material 14 is formed of an alloy mainly constituted by Ni or a metal material constituted by Ni. The core material is formed of copper or an alloy containing copper as a main component. It is of course possible to omit the core material. The discharge member 15 is formed of, for example, a noble metal, such as Pt, Ir, Ru, Rh, and the like, or W, which has spark-wear resistance higher than that of the base material 14, or an alloy mainly constituted by such a noble metal or W.

A metal terminal 16 is a bar-shaped member to which a high-voltage cable (not illustrated) is connected, and the front-end side of the metal terminal 16 is disposed in the insulator 11. The metal terminal 16 is electrically connected in the axial hole 12 to the center electrode 13.

The metal shell 17 is a substantially cylindrical metallic member fixed to a screw hole (not illustrated) of an internal combustion engine. The metal shell 17 is formed of a metal material (for example, low-carbon steel or the like) having conductivity. The metal shell 17 is fixed to the outer periphery of the insulator 11. The ground electrode 18 is connected to the front end of the metal shell 17.

The ground electrode 18 includes a base material 19 connected to the metal shell 17 and a discharge member 20 bonded to the base material 19. In the base material 19, a core material having excellent thermal conductivity is embedded. The base material 19 is formed of a metal material constituted by an alloy mainly constituted by Ni. The core material is formed of copper of an alloy containing copper as a main component. It is of course possible to omit the core material and form the entirety of the base material 19 with an alloy mainly constituted by Ni. The base material 19 contains Ni, Cr, Si, Al, Mn, C, and Fe. Note that elements other than these elements may be contained.

The discharge member 20 is formed of an alloy mainly constituted by Pt and containing Ni. The discharge member 20 may contain at least one of Rh, Ir, and Ru. A discharge surface 21 of the discharge member 20 faces the center electrode 13 with a spark gap 22 interposed therebetween. In the present embodiment, the discharge member 20 has a disc shape having the discharge surface 21 of a circular shape. The discharge member 20 in which a height H (refer to FIG. 2) from the base material 19 to the discharge surface 21 of the discharge member 20 is 0.05 mm to 0.35 mm is used.

The spark plug 10 is manufactured, for example, by the following method. First, the center electrode 13 is inserted into the axial hole 12 of the insulator 11. After the metal terminal 16 is inserted into the axial hole 12 and conductivity between the metal terminal 16 and the center electrode 13 is ensured, the metal shell 17 to which the base material 19 has been previously bonded is assembled to the outer periphery of the insulator 11. After the discharge member 20 is bonded to the base material 19 by resistance welding, the base material 19 is bent such that the discharge member 20 faces the center electrode 13 in the axial direction, thereby obtaining the spark plug 10. It is possible to subject the base material 19 to which the discharge member 20 is bonded to heat treatment after the resistance welding.

Figure 2:
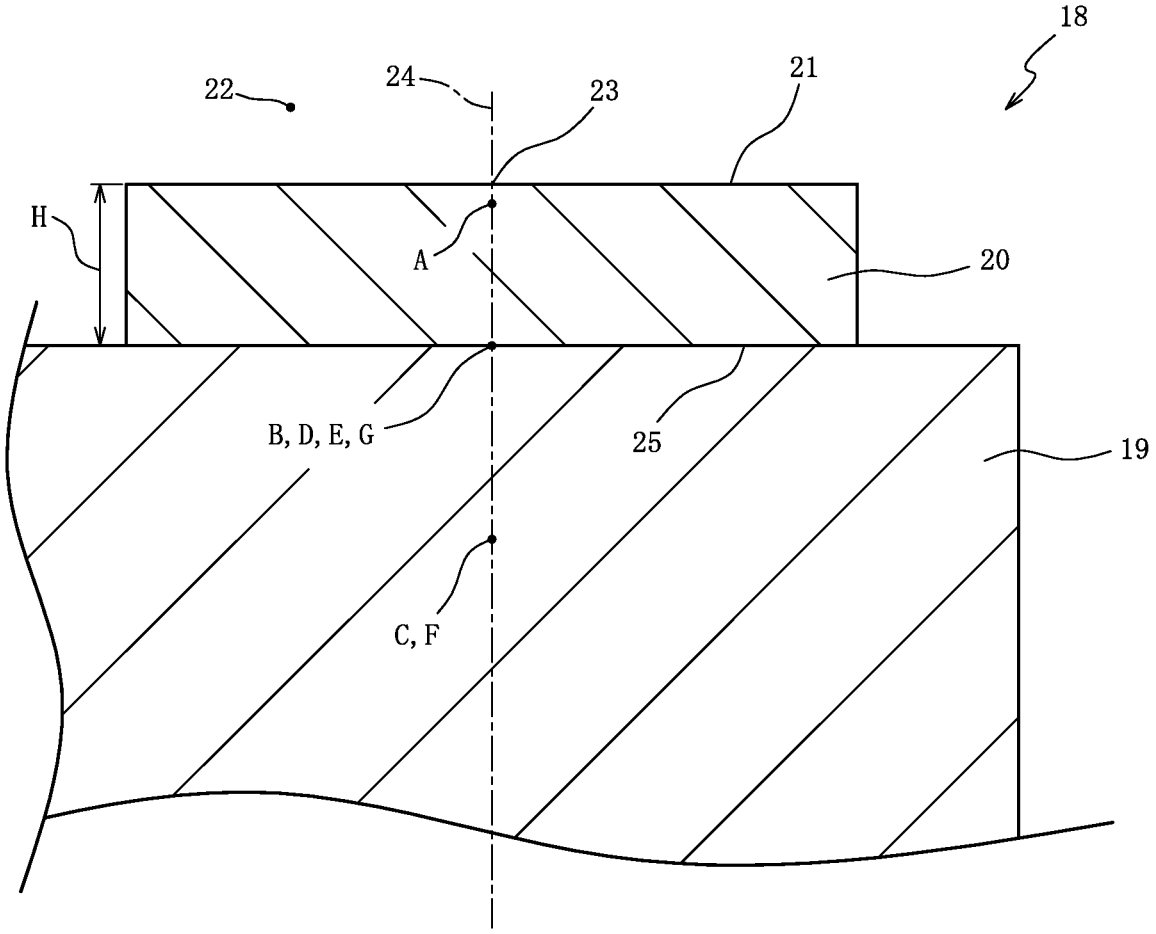
FIG. 2 is a sectional view of a ground electrode.

FIG. 2 is a sectional view of the ground electrode 18 including, of straight lines passing through a center 23 of the discharge surface 21 of the discharge member 20, the straight line 24 parallel to the axis O. In the present embodiment, the axis O of the spark plug 10 is coincident with the straight line 24. At least a portion of the discharge member 20 is bonded to the base material 19 with a diffusion layer 25 interposed therebetween. The diffusion layer 25 bonds the base material 19 and the discharge member 20 to each other by diffusion of atoms (interatomic bonding) generated between the base material 19 and the discharge member 20. A fused portion in which the discharge member 20 and the base material 19 have been fused and solidified may be formed at a portion of the interface between the discharge member 20 and the base material 19. The fused portion is, however, not included in the diffusion layer 25.

Figure 3:
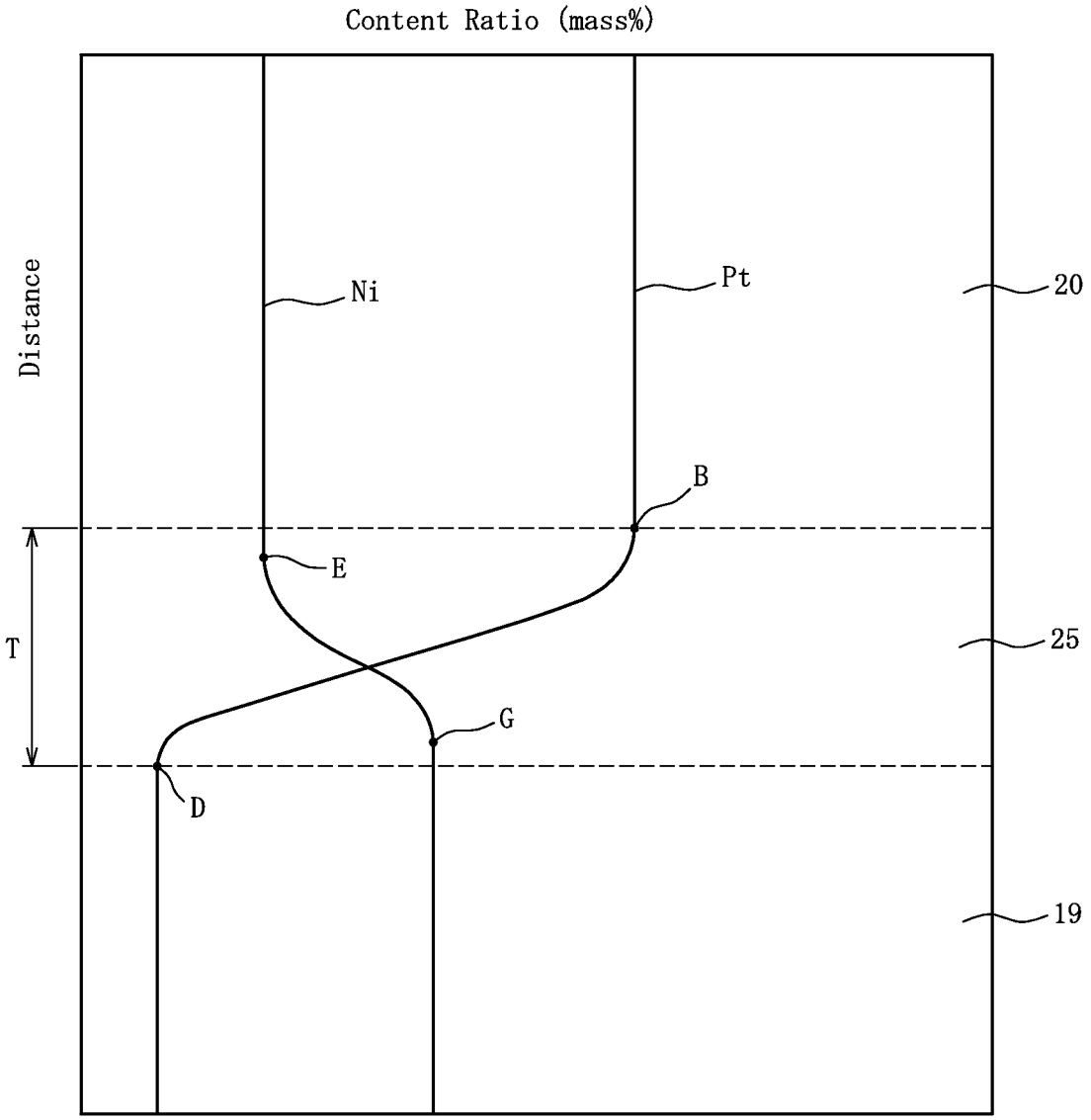
FIG. 3 illustrates element distribution in the vicinity of a diffusion layer.

FIG. 3 illustrates element distribution in the vicinity of the diffusion layer 25. In FIG. 3, the content ratios of Pt and Ni are plotted. The content ratios were measured on the straight line 24 perpendicular to the diffusion layer 25 in a polished surface of the ground electrode 18 including the straight line 24. The measurement was performed from the discharge member 20 to the base material 19 at certain (for example, 1 μm) intervals. The horizontal axis of FIG. 3 represents the content ratios (mass %) of elements, and the content ratios are lower toward the left side. The vertical axis represents the distance (that is, the position of the spark plug 10 in the direction of the axis O), and the lower side indicates the front-end side of the spark plug 10.

The content ratios of elements contained in the base material 19 and the discharge member 20 are obtainable by WDS analysis of a FE-EPMA (JXA 8500F manufactured by JEOL Ltd.) loaded with a hot cathode field emission-type electron gun. After qualitative analysis is performed by WDS analysis, mass composition is measured by performing quantitative analysis, thereby measuring content ratios (mass %) relative to the total sum of the detected mass compositions of the elements.

In the present embodiment, the base material 19 constituted by an alloy mainly constituted by Ni does not contain Pt. In contrast, the discharge member 20 is mainly constituted by Pt and contains Ni. The content ratio of Ni of the discharge member 20 is lower than the content ratio of Ni of the base material 19. It is thus possible, when distribution of Pt and Ni is known, to specify the position of the diffusion layer 25 in which atoms diffuse between the base material 19 and the discharge member 20.

In the diffusion layer 25, the diffusion of the atoms is generated due to hot press bonding between the discharge member 20 and the base material 19. In the diffusion layer 25, the content ratio of a specific element (Pt in the present embodiment) contained in the discharge member 20 continuously decreases from the discharge member 20 toward the base material 19. In the diffusion layer 25, the content ratio of a specific element (Ni in the present embodiment) contained in the base material 19 continuously decreases from the base material 19 toward the discharge member 20.

Figure 5:
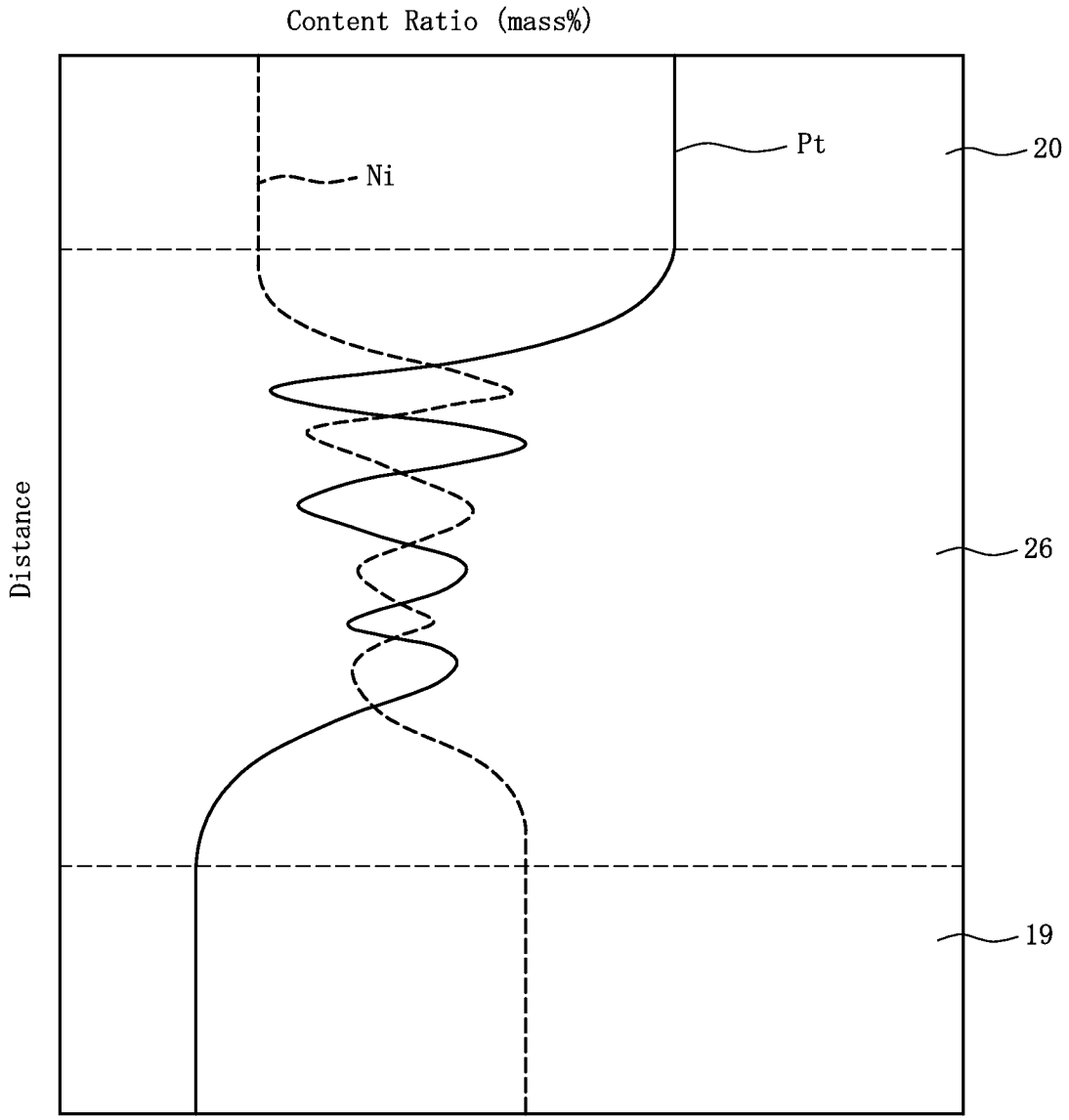
FIG. 5 illustrates element distribution in the vicinity of a fused portion.

A fused portion 26 formed by laser welding will be described. FIG. 5 illustrates element distribution in the vicinity of the fused portion 26 in a sample in which the fused portion 26 formed by laser welding is formed between the base material 19 and the discharge member 20. In FIG. 5, content ratios of Pt and Ni are plotted. The content ratios were measured from the discharge member 20 to the base material 19 across the fused portion 26 at certain (for example, 1 μm) intervals. The horizontal axis of FIG. 5 represents content ratios (mass %), and the content ratios are lower toward the left side. The vertical axis represents the distance (that is, the position of the spark plug in the direction of the axis O), and the lower side indicates the front-end side of the spark plug. In the fused portion 26, the base material 19 and the discharge member 20 that have been fused flow and solidify, and, differently from the diffusion layer 25, elements (Pt and Ni) are thereby mixed together with no relation to the distance from the discharge member 20 or the base material 19.

Referring back to FIG. 2, a method of measuring a thickness T of the diffusion layer 25 will be described. In FIG. 2, the straight line 24 passing through the center 23 of the discharge surface 21 of the discharge member 20 perpendicularly intersects the diffusion layer 25, and thus, the content ratios of Pt and Ni at measurement points on the straight line 24 are measured from the discharge member 20 to the base material 19 by WDS analysis of a FE-EPMA.

First, a measurement point A away from the discharge surface 21 of the discharge member 20 by 10 μm toward the base material 19 is set as an initial measurement point (base point) of the discharge member 20, and quantitative analysis is performed at five measurement points disposed at 10 μm intervals toward the base material 19. An average value of the content ratios of Pt at the five measurement points is considered as a content ratio W1 of Pt of the discharge member 20.

Next, quantitative analysis is performed at measurement points disposed on the straight line 24 at constant intervals (for example, 1 μm) toward the base material 19 from, of the five measurement points of the discharge member 20, the measurement point closest to the base material 19. Among the measurement points, all of the measurement points at each of which a content ratio W2 of Pt is W1 or less and at each of which the content ratios of Pt at measurement points closer than the measurement point to the base material 19 are W2 or less are determined, and, among the all of the measurement points, a measurement point B closest to the discharge member 20 is specified. The position of the measurement point B is considered as the position of the border between the discharge member 20 and the diffusion layer 25 for which Pt has been measured.

Next, a measurement point C on the straight line 24 away from the measurement point B by 100 μm in a direction away from the discharge member 20 is set as an initial measurement point (base point) of the base material 19, and quantitative analysis is performed at five measurement points disposed on the straight line 24 at 10 μm intervals in the direction away from the discharge member 20. An average value of the content ratios of Pt at the five measurement points is considered as a content ratio W3 of Pt of the base material 19.

Next, quantitative analysis is performed at measurement points disposed on the straight line 24 at constant intervals (for example, 1 μm) toward the discharge member 20 from, of the five measurement points of the base material 19, the measurement point C closest to the discharge member 20. Among the measurement points, all of the measurement points at each of which a content ratio W4 of Pt is W3 or more and at each of which the content ratios of Pt at measurement points closer than the measurement point to the discharge member 20 are W4 or more are determined, and among the all of the measurement points, a measurement point D closest to the base material 19 is specified. The position of the measurement point D is considered as the position of the border between the base material 19 and the diffusion layer 25 for which Pt has been measured. A distance in the axial direction between the measurement point B and the measurement point D is considered as a thickness T1 of the diffusion layer 25 for which Pt has been measured.

Similarly, the measurement point A away from the discharge surface 21 of the discharge member 20 by 10 μm toward the base material 19 is set as an initial measurement point (base point) of the discharge member 20, and quantitative analysis is performed at five measurement points disposed on the straight line 24 at 10 μm intervals toward the base material 19. An average value of content ratios of Ni at the five measurement points is considered as a content ratio W5 of Ni of the discharge member 20.

Next, quantitative analysis is performed at measurement points disposed on the straight line 24 at constant intervals (for example, 1 μm) toward the base material 19 from, of the five measurement points of the discharge member 20, the measurement point closest to the base material 19. Among the measurement points, all of the measurement points at each of which a content ratio W6 of Ni is W5 or more and at each of which the content ratios of Ni at measurement points closer than the measurement point to the base material 19 are W6 or more are determined, and among the all of the measurement points, a measurement point E closest to the discharge member 20 is specified. The position of the measurement point E is considered as the position of the border between the discharge member 20 and the diffusion layer 25 for which Ni has been measured.

Next, a measurement point F on the straight line 24 away from the measurement point E by 100 μm in a direction away from the discharge member 20 is set as an initial measurement point (base point) of the base material 19, and quantitative analysis is performed at five measurement points disposed on the straight line 24 at 10 μm intervals in the direction away from the discharge member 20. An average value of content ratios of Ni at the five measurement points is considered as a content ratio W7 of Ni of base material 19.

Next, quantitative analysis is performed at measurement points disposed on the straight line 24 at constant intervals (for example, 1 μm) toward the discharge member 20 from, of the five measurement points of the base material 19, the measurement point F closest to the discharge member 20. Among the measurement points, all of the measurement points at each of which a content ratio W8 of Ni is W7 or less and at each of which the content ratios of Ni at measurement points closer than the measurement point to the discharge member 20 are W8 or less are determined, and among the all of the measurement points, a measurement point G closest to the base material 19 is specified. The position of the measurement point G is considered as the position of the border between the base material 19 and the diffusion layer 25 for which Ni has been measurement. A distance in the axial direction between the measurement point E and the measurement point G is considered as a thickness T2 of the diffusion layer 25 for which Ni has been measured.

Between the thickness T2 and the thickness T1 of the diffusion layer 25 for which Pt has been measured, the larger thickness is considered as the thickness T (refer to FIG. 3) of the diffusion layer 25. The thickness T of the diffusion layer 25 is preferably 5 μm or more, considering peeling resistance of the discharge member 20, but is usually less than 70 μm.

WDS analysis of a FE-EPMA for determining mass compositions of the base material 19 and the discharge member 20 at each set of the five measurement points having the measurement point A, C, and F as respective base points is performed under conditions of an acceleration voltage of 20 kV and a spot diameter of 10 μm. WDS analysis to specify the measurement points B, D, E, and G for determining the thickness of the diffusion layer 25 is performed under conditions of an acceleration voltage of 20 kV and a spot diameter of 1 μm.

Elements to be analyzed are not limited to Pt and Ni. Elements to be analyzed may be two types of elements selected, as appropriate, from the elements contained in the base material 19 or the discharge member 20. The thickness of the diffusion layer 25 is considered to be easily measured by selecting Ni, which is a most contained element in the base material 19, and an element most contained in the discharge member 20.

Depending on the surface shape of the discharge surface 21 of the discharge member 20 or the thickness of the diffusion layer 25, there is a possibility of concentration gradient being present among the measurement points A, C, and F or a possibility of the measurement points A, C, and F being positioned in the diffusion layer 25. In such a case, the measured values at the measurement points A, C, and F do not represent the compositions of the discharge member 20 and the base material 19. Measurement is thus performed with the positions of the measurement points A, C, and F changed, as appropriate. In short, the measurement point A can be determined at any portion as long as measured values that represent the composition of the discharge member 20 before bonding are obtainable, and the measurement points C and F can be determined at any portions as long as measured values that represent the composition of the base material 19 before bonding are obtainable.

Figure 4:
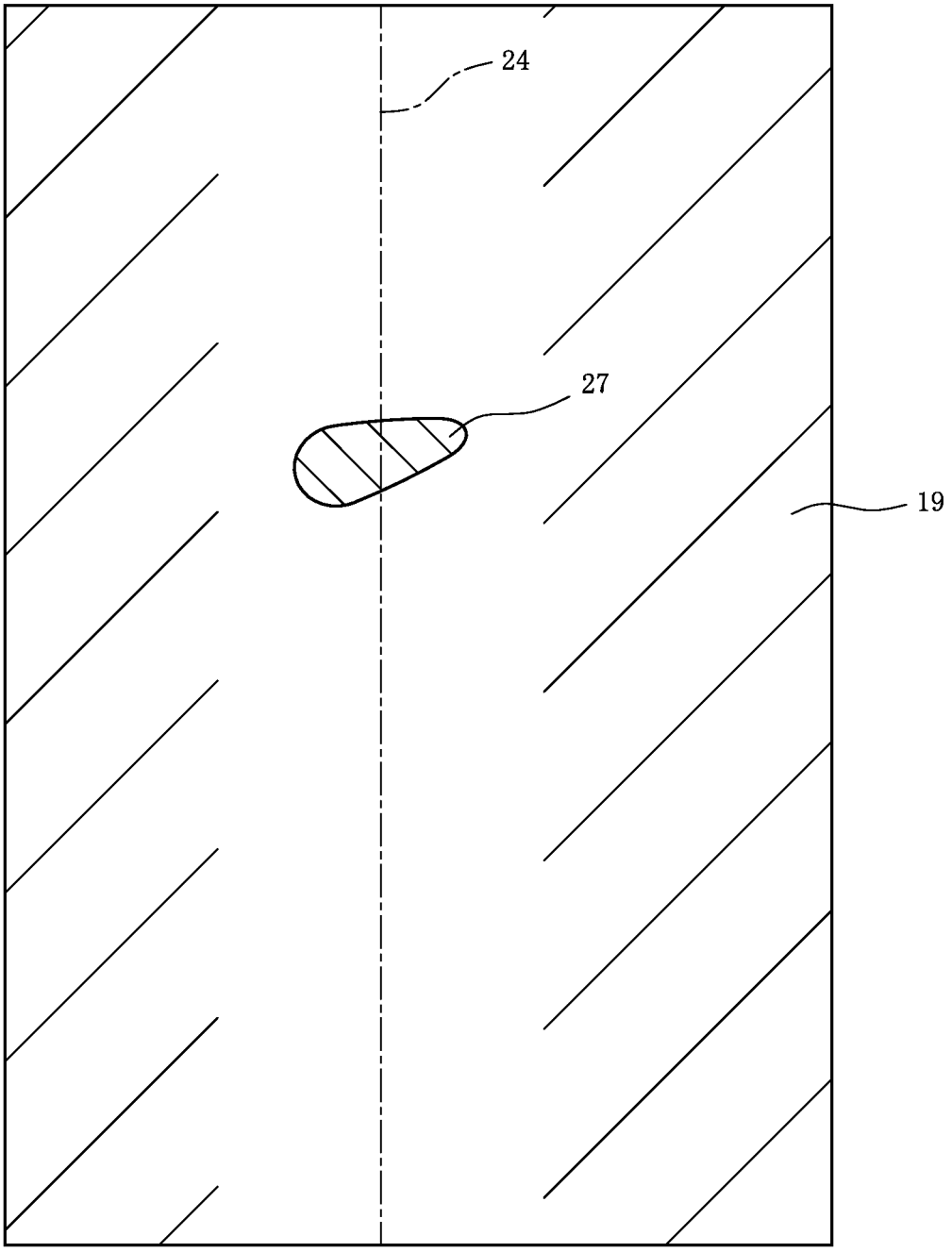
FIG. 4 is a sectional view of a base material.

FIG. 4 is a sectional view of the base material 19. For example, when a segregate 27 of the discharge member 20 or the base material 19 is present on the straight line 24, when a fused portion (not illustrated) is present adjacent to the diffusion layer 25, or when a void (not illustrated) of the base material 19 or the discharge member 20 is present on the straight line 24, that is, when measured values are considered to be influenced by the segregate 27, a void, or the like, two measurement points, instead of the measurement points of the measurement, closest to the measurement points of the measurement and not influenced by the segregate 27, the void, or the like are selected, and an average value of values measured at the two measurement points is employed.

The base material 19 is a solid solution containing Ni. The segregate 27 has a crystal structure that differs from that of the solid solution of the base material 19. The segregate 27 is, for example, an element constituting the base material 19 or impurities, such as carbide, nitride, oxide, and intermetallic compounds. A suitable amount of the segregate 27 helps ensuring the strength of the base material 19.

Incidentally, a spark plug in which at least a portion of a discharge member constituted by a Pt—Ni alloy is bonded to a base material with a diffusion layer interposed therebetween has a problem, when the base material contains Fe, that Fe may have a great influence on the wear resistance and the peeling resistance of the discharge member. In other words, when the temperature of a ground electrode rises under the usage environment of the spark plug, mutual diffusion easily occurs between the discharge member and the base material. The discharge member contains Ni, and Fe constituting the base material thus easily diffuses in the discharge member. Fe naturally has properties of decreasing the melting point of a Pt alloy, and, therefore, the discharge member is easily worn out.

Moreover, when the Fe diffusing in the discharge member combines with Pt of the discharge member and generates an intermetallic compound at a bonded part between the discharge member and the base material, the bonded part becomes brittle. The generation of the intermetallic compound causes a volume change and thus increases the stress of the bonded part between the discharge member and the base material. As a result, the discharge member bonded to the base material with the diffusion layer interposed therebetween easily peels off.

In contrast, in the spark plug in which the discharge member is bonded to the base material with the laser-welded fused portion 26 (refer to FIG. 5) interposed therebetween, a thermal stress generated due to a difference in liner thermal expansion coefficient between the base material and the discharge member is buffered by the fused portion 26. The Fe contained in the base material thus has no great influence on peel-off of the discharge member.

According to the present embodiment, in the spark plug 10 in which at least a portion of the discharge member 20 is bonded to the base material 19 with the diffusion layer 25 interposed therebetween, the base material 19 contains 50 mass % or more of Ni, 8 mass % or more and 40 mass % or less of Cr, 0.01 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 5 mass % or less of Fe.

The content ratio (mass %) of each element of the base material 19 is calculated on the basis of analysis results of mass composition by WDS analysis of a FE-EPMA at the five measurement points having the measurement point C (refer to FIG. 2) as the base point. The content ratio (mass %) of each element of the base material 19 may be calculated from the five measurement points having the measurement point F (refer to FIG. 2), instead of the measurement point C, as the base point. In short, measurement can be performed at any part as long as measured values that represent the composition of the base material 19 before bonding are obtainable.

By containing 50 mass % or more of Ni, the base material 19 can ensure heat resisting properties of the base material 19. By containing 8 mass % or more and 40 mass % or less of Cr, it is possible to ensure oxidation resistance of the base material 19 due to a Cr oxide film formed on the surface of the base material 19 and to suppress generation of the segregate 27, such as Cr Nitride and Cr carbide. By containing 0.01 mass % or more and 2 mass % or less of Si, it is possible to ensure oxidation resistance of the base material 19 and to suppress generation of the segregate 27 constituted by a Si compound. By containing 0.01 mass % or more and 2 mass % or less of Al, it is possible to ensure high-temperature strength and high-temperature corrosion resistance.

By containing 0.01 mass % or more and 2 mass % or less of Mn, the base material 19 can prevent the base material 19 from becoming brittle due to desulfurization and can suppress generation of the segregate 27, such as Mn sulfide. By containing 0.01 mass % or more and 0.1 mass % or less of C, it is possible to ensure high-temperature strength and to suppress generation of the segregate 27, such as Cr carbide. By containing 0.001 mass % or more and 5 mass % or less of Fe, it is possible to suppress generation of iron oxide. The content ratios of elements of the base material 19 other than Ni, Cr, Si, Al, Mn, C, and Fe, and the content ratios of inevitable impurity elements are preferably 1 mass % or less in total and more preferably 0.4 mass % or less in total.

The base material 19 contains 0.001 mass % or more and 5 mass % or less of Fe and 0.01 mass % or more and 2 mass % or less of Si. Such a composition causes Si diffusing in the discharge member 20 to accelerate diffusion of the Fe diffusing in the discharge member 20. It is thus possible to cause Fe to easily reach the surface of the discharge member 20. The Fe that has reached the surface of the discharge member 20 easily peels off from the surface of the discharge member 20 after forming an oxide film on the surface. Consequently, an increase of the content ratio of Fe in an inner portion of the discharge member 20 can be suppressed. Thus, the melting point of the discharge member 20 is suppressed from decreasing, and it is possible to suppress the discharge member 20 from being worn out.

The spark plug 10 satisfies $(K+L)/(M+N) \leq 1.14$ where, with Pt, Rh, Ir, and Ru considered as a P group, K (at %) represents the atomic concentration of the P group of the discharge member 20, L (at %) represents the atomic concentration of the P group of the base material 19, M (at %) represents the atomic concentration of Ni of discharge member 20, and N (at %) represents the atomic concentration of Ni of the base material 19. By setting the atomic concentration of Ni to be relatively high, it is possible to cause Fe diffusing in the discharge member 20 and the atoms of the P group contained in the discharge member 20 not to easily react relatively. It is possible to suppress generation of an intermetallic compound by Fe and the atoms of the P group contained in the discharge member 20, and it is thus possible to suppress the diffusion layer 25 and the interface between the diffusion layer 25 and the discharge member 20 from becoming brittle. It is also possible to suppress a thermal stress of the interface between the diffusion layer 25 and the discharge member 20, and it is thus possible to suppress the discharge member 20 bonded to the base material 19 from peeling off. $(K+L)/(M+N) \leq 0.82$ is more preferable.

The atomic concentrations K, L, M, and N are calculated on the basis of analysis results of mass composition by WDS analysis of a FE-EPMA at each set of the five measurement points having the measurement point A and C (refer to FIG. 2) as respective base points. The atomic concentration (at %) indicates by percentage ratios obtained by dividing the content ratio (mass %) of each element by the atomic weight of the element. As the atomic weights of the elements, data listed in ASM Alloy Phase Diagram Database™ is used. In the present embodiment, the atomic concentration L of the P group of the base material 19 is 0 (at %).

$X/Y \geq 0.04$, where X (mass %) represents the content ratio of Si of the base material 19 and Y (mass %) represents the content ratio of Fe of the base material 19, is preferable. Such a configuration causes Si diffusing in the discharge member 20 to further accelerate diffusion of Fe diffusing in the discharge member 20. Therefore, it is possible to further suppress the discharge member 20 from being worn out. X/Y 0.35 is more preferable.

The area of the segregate 27 occupying the area of the base material 19 in a cross-section of the base material 19 is preferably 0.01% or more and 4% or less. That is to prevent the base material 19 from becoming brittle and to ensure the strength of the base material 19. When the area of the segregate 27 is 0.01% or more, the high-temperature strength of the base material 19 is further increased, and thus, the base material 19 becomes not easily deformable. Consequently, the oxide film generated on the base material 19 does not easily peel off, which suppresses oxygen atoms from diffusing into the interface between the diffusion layer 25 and the discharge member 20, the interface between the diffusion layer 25 and the base material 19, and an inner portion of the diffusion layer 25. As a result, it is possible to further suppress generation of oxides.

When the area of the segregate 27 is 4% or less, the base material 19 is suppressed from becoming brittle. Consequently, cracks do not easily occur in the interface between the diffusion layer 25 and the discharge member 20, the interface between the diffusion layer 25 and the base material 19, and the diffusion layer 25, and thus, the discharge member 20 does not easily peel off. Accordingly, it is preferable that the area of the segregate 27 occupying the area of the base material 19 be 0.01% or more and 4% or less.

The segregate 27 can be detected through mapping or analysis of composition images by an EPMA loaded with a wavelength-dispersive X-ray spectrometer detector (WDX or WDS), a SEM attached with an energy dispersive X-ray spectrometer detector (EDX or EDS), or the like. After photographing a cross-section of the base material 19 in a rectangular visual field having a size of 400 μm×600 μm, the area (%) of the segregate 27 occupying the area of the base material 19 is obtained through image processing.

EXAMPLES

The present invention will be more specifically described with an example. The present invention is, however, not limited by the example.

(Forming Samples 1 to 63)

An examiner prepared various types of the base materials 19 and the disc-shaped discharge members 20 having the compositions indicated in Table 1 and Table 2. The examiner bonded the discharge members 20 to the base materials 19 by resistance welding and obtained spark plugs 10 of samples 1 to 63. To perform cross-sectional observation and the like, in addition to evaluation of peeling resistance and wear resistance, of each sample, a plurality of the samples formed under the same conditions were prepared. The thickness T of the diffusion layer 25 formed between the base material 19 and the discharge member 20 was less than 70 μm in all of the samples. A height H of the discharge surface 21 of the discharge member 20 from the base material 19 was 0.25 mm in all of the samples.

TABLE 1

| | Base Material | | | | | | | | | | | |
|---|---|---|---|---|---|---|---|---|---|---|---|---|
| | Content Ratio(mass %) | | | | | | | | | N | Si/Fe | |
| No | Ni | Cr | Si | Al | Mn | C | Fe | Ti | Y | (at %) | (X/Y) | Segragete |
| 1 | 87.1 | 8.0 | 0.70 | 0.10 | 2.00 | 0.060 | 2.000 | — | — | 85.1 | 0.35 | good |
| 2 | 88.1 | 8.0 | 0.70 | 0.10 | 2.00 | 0.060 | 1.000 | — | — | 86.1 | 0.70 | good |
| 3 | 88.9 | 8.0 | 0.70 | 0.10 | 2.00 | 0.060 | 0.200 | — | — | 86.9 | 3.50 | good |
| 4 | 89.0 | 8.0 | 0.70 | 0.10 | 2.00 | 0.060 | 0.100 | — | — | 87.1 | 7.00 | good |
| 5 | 90.5 | 8.0 | 0.01 | 0.90 | 0.50 | 0.060 | 0.001 | — | — | 88.4 | 10.00 | good |
| 6 | 89.5 | 8.0 | 1.00 | 0.90 | 0.50 | 0.035 | 0.100 | — | — | 86.6 | 10.00 | good |
| 7 | 79.5 | 18.0 | 1.00 | 0.90 | 0.50 | 0.035 | 0.100 | — | — | 75.9 | 10.00 | good |
| 8 | 75.5 | 22.0 | 1.00 | 0.90 | 0.50 | 0.035 | 0.100 | — | — | 71.8 | 10.00 | good |
| 9 | 72.5 | 25.0 | 1.00 | 0.90 | 0.50 | 0.035 | 0.100 | — | — | 68.7 | 10.00 | good |
| 10 | 72.5 | 25.0 | 1.00 | 0.90 | 0.50 | 0.035 | 0.100 | — | — | 68.7 | 10.00 | good |
| 11 | 72.9 | 25.0 | 0.70 | 0.90 | 0.50 | 0.035 | 0.001 | — | — | 69.3 | 700.00 | good |
| 12 | 69.5 | 28.0 | 1.00 | 0.90 | 0.50 | 0.035 | 0.100 | 0.3 | 0.1 | 65.6 | 10.00 | good |
| 13 | 70.6 | 25.0 | 1.00 | 0.90 | 0.50 | 0.035 | 2.000 | — | — | 66.8 | 0.50 | good |
| 14 | 72.1 | 25.0 | 0.90 | 0.90 | 0.50 | 0.060 | 0.100 | — | — | 68.3 | 9.00 | bad |
| 15 | 82.3 | 35.0 | 1.15 | 0.90 | 0.50 | 0.035 | 0.100 | — | — | 58.2 | 11.50 | good |
| 16 | 52.5 | 45.0 | 1.00 | 0.90 | 0.50 | 0.035 | 0.100 | — | — | 48.5 | 10.00 | good |
| 17 | 71.8 | 25.0 | 0.50 | 0.90 | 0.50 | 0.035 | 1.300 | — | — | 68.3 | 0.38 | good |
| 18 | 71.6 | 25.0 | 0.70 | 0.90 | 0.50 | 0.035 | 1.300 | — | — | 68.0 | 0.54 | good |
| 19 | 72.5 | 25.0 | 1.00 | 0.90 | 0.50 | 0.035 | 0.001 | — | — | 68.8 | 1000.00 | good |
| 20 | 72.5 | 25.0 | 1.00 | 0.90 | 0.50 | 0.035 | 0.001 | — | — | 68.8 | 1000.00 | good |
| 21 | 72.1 | 25.0 | 1.30 | 0.90 | 0.50 | 0.035 | 0.200 | — | — | 68.1 | 6.50 | good |
| 22 | 71.9 | 25.0 | 1.50 | 0.90 | 0.50 | 0.035 | 0.200 | — | — | 67.7 | 7.50 | good |
| 23 | 71.4 | 25.0 | 2.00 | 0.90 | 0.50 | 0.035 | 0.200 | — | — | 66.9 | 10.00 | good |
| 24 | 71.2 | 25.0 | 2.20 | 0.90 | 0.50 | 0.035 | 0.200 | — | — | 66.6 | 11.00 | good |
| 25 | 73.4 | 25.0 | 1.00 | 0.01 | 0.50 | 0.035 | 0.100 | — | — | 70.2 | 10.00 | good |
| 26 | 73.1 | 25.0 | 1.00 | 0.30 | 0.50 | 0.035 | 0.100 | — | — | 69.7 | 10.00 | good |
| 27 | 72.8 | 25.0 | 1.00 | 0.60 | 0.50 | 0.035 | 0.100 | — | — | 69.2 | 10.00 | good |
| 28 | 72.5 | 25.0 | 1.00 | 0.90 | 0.50 | 0.010 | 0.100 | — | — | 68.7 | 10.00 | good |
| 29 | 72.2 | 25.0 | 1.00 | 1.20 | 0.50 | 0.035 | 0.100 | — | — | 68.1 | 10.00 | good |
| 30 | 72.2 | 25.0 | 1.00 | 1.20 | 0.50 | 0.035 | 0.100 | — | — | 68.1 | 10.00 | good |
| 31 | 72.0 | 25.0 | 1.00 | 1.40 | 0.60 | 0.035 | 0.100 | — | — | 67.8 | 10.00 | good |
| 32 | 71.4 | 25.0 | 1.00 | 2.00 | 0.50 | 0.010 | 0.100 | — | — | 66.9 | 10.00 | good |
| 33 | 71.2 | 25.0 | 1.00 | 2.20 | 0.50 | 0.035 | 0.100 | — | — | 66.5 | 10.00 | good |

TABLE 1-continued

| | Discharge Member | | | | | | | | |
|---|---|---|---|---|---|---|---|---|---|
| | Content Ratio(mass %) | | | | K | M | (K + L)/ | Worn-out | Peel-off |
| No | Pt | Rh | Ir | Ni | (at %) | (at %) | (M + N) | Property | Property |
| 1 | 90.0 | — | — | 10.0 | 73.0 | 27.0 | 0.65 | A | B |
| 2 | 90.0 | — | — | 10.0 | 73.0 | 27.0 | 0.65 | A | B |
| 3 | 90.0 | — | — | 10.0 | 73.0 | 27.0 | 0.64 | A | B |
| 4 | 90.0 | — | — | 10.0 | 73.0 | 27.0 | 0.64 | A | B |
| 5 | 90.0 | — | — | 10.0 | 73.0 | 27.0 | 0.63 | A | B |
| 6 | 90.0 | — | — | 10.0 | 73.0 | 27.0 | 0.84 | A | B |
| 7 | 90.0 | — | — | 10.0 | 73.0 | 27.0 | 0.71 | A | B |
| 8 | 90.0 | — | — | 10.0 | 73.0 | 27.0 | 0.74 | A | A |
| 9 | 90.0 | — | — | 10.0 | 73.0 | 27.0 | 0.76 | A | A |
| 10 | 80.0 | — | — | 20.0 | 55.0 | 45.0 | 0.48 | A | A |
| 11 | 70.0 | 20.0 | — | 10.0 | 76.0 | 24.0 | 0.81 | A | A |
| 12 | 93.0 | — | — | 7.0 | 80.0 | 20.0 | 0.93 | A | B |
| 13 | 95.0 | — | — | 5.0 | 85.0 | 15.0 | 1.04 | A | B |
| 14 | 93.0 | — | — | 7.0 | 80.0 | 20.0 | 0.91 | A | C |
| 15 | 93.0 | — | — | 7.0 | 80.0 | 20.0 | 1.02 | A | C |
| 16 | 90.0 | — | — | 10.0 | 73.0 | 27.0 | 0.97 | A | E |
| 17 | 93.0 | — | — | 7.0 | 80.0 | 20.0 | 0.91 | A | C |
| 18 | 93.0 | — | — | 7.0 | 80.0 | 20.0 | 0.91 | A | B |
| 19 | 93.0 | — | — | 7.0 | 80.0 | 20.0 | 0.90 | A | B |
| 20 | 80.0 | — | — | 20.0 | 55.0 | 45.0 | 0.48 | A | A |
| 21 | 93.0 | — | — | 7.0 | 80.0 | 20.0 | 0.91 | A | B |
| 22 | 93.0 | — | — | 7.0 | 80.0 | 20.0 | 0.91 | A | C |
| 23 | 93.0 | — | — | 7.0 | 80.0 | 20.0 | 0.92 | A | C |
| 24 | 93.0 | — | — | 7.0 | 80.0 | 20.0 | 0.92 | A | E |
| 25 | 93.0 | — | — | 7.0 | 80.0 | 20.0 | 0.89 | A | C |
| 26 | 93 0 | — | — | 7.0 | 80.0 | 20.0 | 0.89 | A | C |
| 27 | 93.0 | — | — | 7.0 | 80.0 | 20.0 | 0.90 | A | B |
| 28 | 93.0 | — | — | 7.0 | 80.0 | 20.0 | 0.90 | A | B |
| 29 | 93.0 | — | — | 7.0 | 80.0 | 20.0 | 0.91 | A | B |
| 30 | 80.0 | — | — | 20.0 | 55.0 | 45.0 | 0.49 | A | A |
| 31 | 93.0 | — | — | 7.0 | 80.0 | 20.0 | 0.91 | A | B |
| 32 | 93.0 | — | — | 7.0 | 80.0 | 20.0 | 0.92 | A | B |
| 33 | 93.0 | — | — | 7.0 | 80.0 | 20.0 | 0.92 | A | E |

TABLE 2

| | Base Material | | | | | | | | | | | |
|---|---|---|---|---|---|---|---|---|---|---|---|---|
| | Content Ratio(mass %) | | | | | | | | | N | Si/Fe | |
| No | Ni | Cr | Si | Al | Mn | C | Fe | Ti | Y | (at %) | (X/Y) | Segragete |
| 34 | 71.7 | 25.0 | 0.70 | 0.60 | 0.01 | 0.035 | 2.000 | — | — | 68.3 | 0.35 | good |
| 35 | 72.9 | 25.0 | 1.00 | 0.90 | 0.10 | 0.035 | 0.100 | — | — | 69.1 | 10.00 | good |
| 36 | 71.9 | 25.0 | 1.00 | 0.90 | 1.10 | 0.035 | 0.100 | — | — | 68.1 | 10.00 | good |
| 37 | 71.8 | 25.0 | 1.00 | 0.90 | 1.20 | 0.035 | 0.100 | — | — | 68.0 | 10.00 | good |
| 38 | 71.0 | 25.0 | 1.00 | 0.90 | 2.00 | 0.035 | 0.100 | — | — | 67.2 | 10.00 | good |
| 39 | 70.5 | 25.0 | 1.00 | 0.90 | 2.50 | 0.035 | 0.100 | — | — | 66.7 | 10.00 | good |
| 40 | 72.3 | 25.0 | 1.00 | 0.90 | 0.50 | 0.070 | 0.100 | 0.1 | — | 68.4 | 10.00 | good |
| 41 | 72.3 | 25.0 | 1.00 | 0.90 | 0.50 | 0.070 | 0.100 | 0.1 | — | 68.4 | 10.00 | good |
| 42 | 72.3 | 25.0 | 1.00 | 0.90 | 0.50 | 0.070 | 0.100 | 0.1 | — | 68.4 | 10.00 | bad |
| 43 | 72.4 | 25.0 | 1.00 | 0.90 | 0.50 | 0.100 | 0.100 | — | — | 68.4 | 10.00 | bad |
| 44 | 72.4 | 25.0 | 1.00 | 0.90 | 0.50 | 0.150 | 0.100 | — | — | 68.3 | 10.00 | bad |
| 45 | 86.9 | 8.0 | 0.10 | 0.01 | 0.01 | 0.010 | 5.000 | — | — | 85.6 | 0.02 | good |
| 46 | 84.7 | 8.0 | 0.15 | 0.10 | 2.00 | 0.060 | 5.000 | — | — | 83.1 | 0.03 | good |
| 47 | 84.6 | 8.0 | 0.20 | 0.10 | 2.00 | 0.060 | 5.000 | — | — | 83.0 | 0.04 | good |
| 48 | 87.9 | 8.0 | 0.15 | 0.10 | 0.01 | 0.060 | 3.750 | — | — | 86.4 | 0.04 | good |
| 49 | 87.5 | 8.0 | 0.30 | 0.10 | 2.00 | 0.060 | 2.000 | — | — | 85.9 | 0.15 | good |
| 50 | 85.4 | 8.0 | 1.50 | 0.01 | 2.00 | 0.060 | 3.000 | — | — | 82.8 | 0.50 | good |
| 51 | 53.4 | 40.0 | 0.20 | 0.90 | 0.50 | 0.035 | 5.000 | — | — | 49.9 | 0.04 | good |
| 52 | 53.4 | 40.0 | 0.20 | 0.90 | 0.50 | 0.035 | 5.000 | — | — | 49.9 | 0.04 | good |
| 53 | 53.4 | 40.0 | 0.20 | 0.90 | 0.50 | 0.035 | 5.000 | — | — | 49.9 | 0.04 | good |
| 54 | 53.4 | 40.0 | 0.20 | 0.90 | 0.50 | 0.035 | 5.000 | — | — | 49.9 | 0.04 | good |
| 55 | 53.4 | 40.0 | 0.20 | 0.90 | 0.50 | 0.035 | 5.000 | — | — | 49.9 | 0.04 | good |
| 56 | 53.4 | 40.0 | 0.20 | 0.90 | 0.50 | 0.035 | 5.000 | — | — | 49.9 | 0.04 | good |
| 57 | 87.6 | 5.0 | 0.20 | 0.10 | 2.00 | 0.060 | 5.000 | — | — | 86.3 | 0.04 | good |
| 58 | 81.7 | 8.0 | 0.20 | 3.00 | 2.00 | 0.060 | 5.000 | — | — | 77.6 | 0.04 | good |
| 59 | 83.5 | 8.0 | 0.30 | 0.10 | 2.00 | 0.060 | 6.000 | — | — | 81.8 | 0.05 | good |
| 60 | 74.6 | 15.0 | 0.20 | 1.40 | 0.80 | 0.035 | 8.000 | — | — | 71.4 | 0.03 | good |

TABLE 2-continued

| | | | | | | | | | | | | |
|---|---|---|---|---|---|---|---|---|---|---|---|---|
| 61 | 60.6 | 23.0 | 0.20 | 1.40 | 0.80 | 0.035 | 14.000 | — | — | 57.3 | 0.01 | good |
| 62 | 82.4 | 8.0 | 2.50 | 0.10 | 2.00 | 0.035 | 5.000 | — | — | 78.9 | 0.50 | good |
| 63 | 46.4 | 41.0 | 2.50 | 2.50 | 2.50 | 0.150 | 5.000 | — | — | 41.4 | 0.50 | good |

| | Discharge Member | | | | | | | | |
|---|---|---|---|---|---|---|---|---|---|
| | Content Ratio(mass %) | | | | K | M | (K + L)/ | Worn-out | Peel-off |
| No | Pt | Rh | Ir | Ni | (at %) | (at %) | (M + N) | Property | Property |
| 34 | 93.0 | — | — | 7.0 | 80.0 | 20.0 | 0.91 | A | C |
| 35 | 93.0 | — | — | 7.0 | 80.0 | 20.0 | 0.90 | A | B |
| 36 | 93.0 | — | — | 7.0 | 80.0 | 20.0 | 0.91 | A | B |
| 37 | 93.0 | — | — | 7.0 | 80.0 | 20.0 | 0.91 | A | C |
| 38 | 93.0 | — | — | 7.0 | 80.0 | 20.0 | 0.92 | A | C |
| 39 | 93.0 | — | — | 7.0 | 80.0 | 20.0 | 0.92 | A | E |
| 40 | 80.0 | — | — | 20.0 | 55.0 | 45.0 | 0.49 | A | A |
| 41 | 93.0 | — | — | 7.0 | 80.0 | 20.0 | 0.90 | A | B |
| 42 | 93.0 | — | — | 7.0 | 80.0 | 20.0 | 0.90 | A | C |
| 43 | 93.0 | — | — | 7.0 | 80.0 | 20.0 | 0.90 | A | D |
| 44 | 93.0 | — | — | 7.0 | 80.0 | 20.0 | 0.91 | A | E |
| 45 | 90.0 | — | — | 10.0 | 73.0 | 27.0 | 0.65 | D | B |
| 46 | 90.0 | — | — | 10.0 | 73.0 | 27.0 | 0.66 | D | B |
| 47 | 90.0 | — | — | 10.0 | 73.0 | 27.0 | 0.66 | C | B |
| 48 | 90.0 | — | — | 10.0 | 73.0 | 27.0 | 0.64 | C | B |
| 49 | 90.0 | — | — | 10.0 | 73.0 | 27.0 | 0.65 | B | B |
| 50 | 90.0 | — | — | 10.0 | 73.0 | 27.0 | 0.66 | B | B |
| 51 | 80.0 | — | — | 20.0 | 55.0 | 45.0 | 0.58 | C | B |
| 52 | 70.0 | — | 20.0 | 10.0 | 73.0 | 27.0 | 0.95 | C | C |
| 53 | 73.0 | — | 20.0 | 7.0 | 80.0 | 20.0 | 1.14 | C | C |
| 54 | 95.0 | — | — | 5.0 | 85.0 | 15.0 | 1.31 | C | E |
| 55 | 75.0 | — | 20.0 | 5.0 | 85.0 | 15.0 | 1.31 | C | E |
| 56 | 77.0 | — | 20.0 | 3.0 | 91.0 | 9.0 | 1.54 | C | E |
| 57 | 90.0 | — | — | 10.0 | 73.0 | 27.0 | 0.64 | C | E |
| 58 | 90.0 | — | — | 10.0 | 73.0 | 27.0 | 0.70 | C | E |
| 59 | 90.0 | — | — | 10.0 | 73.0 | 27.0 | 0.67 | E | E |
| 60 | 90.0 | — | — | 10.0 | 73.0 | 27.0 | 0.74 | E | E |
| 61 | 90.0 | — | — | 10.0 | 73.0 | 27.0 | 0.87 | E | E |
| 62 | 90.0 | — | — | 10.0 | 73.0 | 27.0 | 0.69 | E | E |
| 63 | 90.0 | — | — | 10.0 | 73.0 | 27.0 | 1.07 | E | E |

The atomic concentration N of Ni contained in the base material 19, the atomic concentration K of the P group contained in the discharge member 20, the atomic concentration M of Ni contained in the discharge member 20, and (K+L)/(M+N) were calculated on the basis of mass compositions according to WDS analysis of a FE-EPMA and indicated in Table 1 and Table 2. The base material 19 did not contain the elements of the P group, and the atomic concentration K of the P group contained in the base material 19 is thus 0.

Table 1 and Table 2 indicate a ratio X/Y, where X (mass %) represents the content ratio of Si of the base material and Y (mass %) represents the content ratio of Fe of the base material. After photographing a cross-section of the base material 19 in a rectangular visual field having a size of 400 μm×600 μm, the area (%) of the segregate 27 occupying the area of the base material 19 was obtained through image processing, and the samples in which the value thereof was 0.01% or more and 4% or less and the samples in which the value thereof was less than 0.01% or more than 4% are indicated as "good" and "bad", respectively, in the column of segregate.

(Peeling Resistance Test)

The examiner conducted 100 hours of a test in which each sample was attached to each cylinder of a 4-cylinder 2-liter engine and each sample was repeatedly subjected to application of a load of 4000 rpm for one minute followed by application of a load of an idling rotation speed for one minute. The temperature of the discharge member 20 at 4000 rpm was 950° C. By using a spark plug in which a hole reaching the vicinity of the discharge member 20 was formed, the temperature of the discharge member 20 was measured, before starting the peeling resistance test, with the temperature measuring junction of a thermocouple disposed at a front end portion of the base material 19 near the discharge member 20. The amount of energy supplied from an ignition coil to each sample in one spark discharge was 150 mJ.

After the tests, with the use of a SEM, each sample was subjected to observation of a cross-section of the ground electrode 18 including, of the straight lines 24 passing through the center 23 of the discharge surface 21 of the discharge member 20, the straight line 24 parallel to the axis O, and lengths L1 and L2 of cracks each developed from both ends of the diffusion layer 25 toward the center of the diffusion layer 25 were measured. Value Q obtained by dividing a total value of L1+L2 of the lengths of the cracks by a length L of the discharge surface 21, that is (L1+L2)/L, was obtained, and classification into five ranks from A to E was performed on the basis of the value Q. The criterion was as follows: A: Q<20%, B: 20%≤Q<30%, C: 30%≤Q<40%, D: 40%≤Q<50%, and E: Q≥50% or the discharge member 20 came off. The results of the peeling resistance tests are indicated in the column of peel-off property in Table 1 and Table 2.

(Wear Resistance Test)

The examiner conducted a test in which each sample was attached to each cylinder of the same engine as the engine used in the peeling resistance test and the engine was operated under conditions with which the temperature of the discharge member 20 became 1000° C. to cause an intake throttle valve to enter a full open state and the engine was continued to be operated for 200 hours. The conditions with which the temperature of the discharge member 20 became 1000° C. was calculated by using a spark plug in which a hole reaching the vicinity of the discharge member 20 was formed and measuring temperature before starting the wear resistance test with the temperature measuring junction of a thermocouple disposed at a front end portion of the base material 19 near the discharge member 20, and examining the relation between the temperature and operating conditions of the engine. The amount of energy supplied from an ignition coil to each sample in one spark discharge was 150 mJ.

After photographing the spark gap 22 of each sample after the test through CT scanning in a direction perpendicular to the axis O, the thickness of a thinnest portion of the discharge member 20 was calculated as a gap increase amount R on the basis of the positions of the discharge surface 21 before and after the test of the discharge member 20 through image processing. Classification into five ranks from A to E was performed on the basis of the gap increase amount R. The criterion was as follows: A: R<0.14 mm, B: 0.14 mm≤R<0.16 mm, C: 0.16 mm≤R<0.18 mm, D: 0.18 mm≤R<0.20 mm, and E: R 0.20 mm or accidental fire occurred during the test. The results of the wear resistance tests are indicated in the column of worn-out property in Table 1 and Table 2.

The samples 16, 24, 33, 39, 44, and 54 to 63 were evaluated as E in the peeling resistance test. In particular, the samples 55, 56, and 59 to 63 were also evaluated as E in the wear resistance test. In the sample 16, the content ratio of Cr of the base material 19 was more than 40 mass %. In the sample 24, the content ratio of Si of the base material 19 was more than 2 mass %. In the sample 33, the content ratio of Al of the base material 19 was more than 2 mass %. In the sample 39, the content ratio of Mn of the base material 19 was more than 2 mass %. In the sample 44, the content ratio of C of the base material 19 was more than 0.1 mass %. In the samples 54 to 56, (K+L)/(M+N)>1.14 was satisfied.

In the sample 57, the content ratio of Cr of the base material 19 was less than 8 mass %. In the sample 58, the content ratio of Al of the base material 19 was more than 2 mass %. In the samples 59 to 61, the content ratio of Fe of the base material 19 was more than 5 mass %. In the sample 62, the content ratio of Si of the base material 19 was more than 2 mass %. In the sample 63, the content ratio of Ni of the base material 19 was less than 50 mass %, the content ratio of Cr was more than 40 mass %, the content ratios of Si, Al, and Mn were each more than 2 mass %, and the content ratio of C was more than 0.1 mass %.

The samples 1 to 16 differ from each other mainly in the content ratio of Cr of the base material 19. The samples 1 to 16 were evaluated as A in the wear resistance test. The samples 14 and 15 were evaluated as C in the peeling resistance test. In the sample 14, the area of a segregate was not 0.01% or more and 4% or less, and 0.82<(K+L)/(M+N)≤1.14 was satisfied. In the sample 15, the content ratio of Cr of the base material 19 was more than 28 mass % and 40 mass % or less, and 0.82<(K+L)/(M+N)≤1.14 was satisfied.

The samples 1 to 7, 12, and 13 were evaluated as B in the peeling resistance test. In the samples 1 to 4, the content ratio of Cr of the base material 19 was 8 mass % or more and less than 22 mass %, the content ratio of Al was 0.01 mass % or more and less than 0.6 mass %, and the content ratio of Mn was more than 1.1 mass % and less than or equal to 2 mass %. In the sample 5, the content ratio of Cr of the base material 19 was 8 mass % or more and less than 22 mass %, and the content ratio of Si was 0.01 mass % or more and less than 0.7 mass %. In the samples 6 and 7, the content ratio of Cr of the base material 19 was 8 mass % or more and less than 22 mass %. In the samples 12 and 13, 0.82<(K+L)/(M+N)≤1.14 was satisfied. It was revealed that the content ratio of Cr of the base material 19 was preferably 8 mass % or more and 40 mass % or less and more preferably 22 mass % or more and 28 mass % or less.

The samples 17 to 24 differ from each other mainly in the content ratio of Si of the base material 19. The samples 17 to 24 were evaluated as A in the wear resistance test. The samples 17, 22, and 23 were evaluated as C in the peeling resistance test. In the sample 17, the content ratio of Si of the base material 19 was 0.01 mass % or more and less than 0.7 mass %, and 0.82<(K+L)/(M+N)≤1.14 was satisfied. In the samples 22 and 23, the content ratio of Si of the base material 19 was 1.3 mass % or more and 2 mass % or less, and 0.82<(K+L)/(M+N)≤1.14 was satisfied. The samples 18, 19, and 21 satisfied 0.82<(K+L)/(M+N)≤1.14 and was evaluated as B in the peeling resistance test. It was revealed that the content ratio of Si of the base material 19 was preferably 0.01 mass % or more and 2 mass % or less and more preferably 0.7 mass % or more and 1.3 mass % or less.

The samples 25 to 33 differ from each other mainly in the content ratio of Al. The samples 25 to 33 were evaluated as A in the wear resistance test. The samples 25 and 26 were evaluated as C in the peeling resistance test. In the samples 25 and 26, the content ratio of Al of the base material 19 was 0.01 mass % or more and less than 0.6 mass %, and 0.82<(K+L)/(M+N)≤1.14 was satisfied. The samples 27 to 29, 31, and 32 satisfied 0.82<(K+L)/(M+N)≤1.14 and were evaluated as B in the peeling resistance test. It was revealed that the content ratio of Al of the base material 19 was preferably 0.01 mass % or more and 2 mass % or less and more preferably 0.7 mass % or more and 1.3 mass % or less.

The samples 34 to 39 differ from each other mainly in the content ratio of Mn of the base material 19. The samples 34 to 39 were evaluated as A in the wear resistance test. The samples 34, 37, and 38 were evaluated as C in the peeling resistance test. In the sample 34, the content ratio of Mn of the base material 19 was 0.01 mass % or more and less than 0.1 mass %, and 0.82<(K+L)/(M+N)≤1.14 was satisfied. In the samples 37 and 38, the content ratio of Mn of the base material 19 was more than 1.1 mass % and less than 2 mass %, and 0.82<(K+L)/(M+N)≤1.14 was satisfied. The samples 35 and 36 satisfied 0.82<(K+L)/(M+N)≤1.14 and were evaluated as B in the peeling resistance test. It was revealed that the content ratio of Mn of the base material 19 was preferably 0.01 mass % or more and 2 mass % or less and more preferably 0.1 mass % or more and 1.1 mass % or less.

The samples 40 to 44 differ from each other mainly in the content ratio of C of the base material 19. In the sample 43, the content ratio of C of the base material 19 was more than 0.07 mass % and less than or equal to 0.1 mass %, and the area of a segregate was not 0.01% or more and 4% or less. The sample 43 satisfied 0.82<(K+L)/(M+N)≤1.14 and was evaluated as D in the peeling resistance test. In the sample 42, the area of a segregate was not 0.01% or more and 4% or less. The sample 42 satisfied 0.82<(K+L)/(M+N)≤1.14 and was evaluated as C in the peeling resistance test. The sample 41 satisfied 0.82<(K+L)/(M+N)≤1.14 and was evaluated as B in the peeling resistance test. It was revealed that the content ratio of C of the base material 19 was preferably 0.01 mass % or more and 0.1 mass % or less and more preferably 0.01 mass % or more and 0.07 mass % or less.

The samples 45 to 53 differ from each other mainly in X/Y and (K+L)/(M+N). The samples 45 and 46 were evaluated as D in the wear resistance test and evaluated as B in the peeling resistance test. In the sample 45, the content ratio of Fe of the base material 19 was more than 2 mass % and less than or equal to 5 mass %, and X/Y<0.04 was satisfied. In the sample 46, the content ratio of Mn of the base material 19 was more than 1.1 mass % and less than or equal to 2 mass %, the content ratio of Fe was more than 2 mass % and less than or equal to 5 mass %, and X/Y<0.04 was satisfied.

The samples 47, 48, and 51 were evaluated as C in the wear resistance test and evaluated as B in the peeling resistance test. In the sample 47, the content ratio of Mn of the base material 19 was more than 1.1 mass % and less than or equal to 2 mass %, the content ratio of Fe was more than 2 mass % and less than or equal to 5 mass %, and 0.04≤X/Y<0.35 was satisfied. In the samples 48 and 51, the content ratio of Fe of the base material 19 was more than 2 mass % and less than or equal to 5 mass %, and 0.04≤X/Y<0.35 was satisfied.

The samples 52 and 53 were evaluated as C in both the wear resistance test and the peeling resistance test. In the samples 52 and 53, the content ratio of Fe of the base material 19 was more than 2 mass % and less than or equal to 5 mass %, 0.04≤X/Y<0.35 was satisfied, and 0.82<(K+L)/(M+N)≤1.14 was satisfied.

The samples 49 and 50 were evaluated as B in both the wear resistance test and the peeling resistance test. In the sample 49, the content ratio of Mn of the base material 19 was more than 1.1 mass % and less than or equal to 2 mass %, and 0.04≤X/Y<0.35 was satisfied. In the sample 50, the content ratio of Mn of the base material 19 was more than 1.1 mass % and less than or equal to 2 mass %, and the content ratio of Fe was more than 2 mass % and less than or equal to 5 mass %.

When the samples 45 and 46 and the samples 47, 48, and 51 are compared, in the wear resistance test, the samples 45 and 46, in which X/Y<0.04, were evaluated as D, and the samples 47, 48, and 51, in which 0.04≤X/Y<0.35, were evaluated as C. Therefore, it was revealed that the wear resistance of the discharge member 20 was able to be improved by 0.04≤X/Y<0.35 being satisfied in the samples 45 to 48 and 51.

When the samples 52 and 53 and the samples 47, 48, and 51 are compared, in the peeling resistance test, the samples 52 and 53, in which 0.82<(K+L)/(M+N)≤1.14, were evaluated as C, and the samples 47, 48, and 51, in which (K+L)/(M+N)≤0.82, were evaluated as B. Therefore, it was revealed that the peeling resistance of the discharge member 20 was able to be improved by (K+L)/(M+N)≤0.82 being satisfied in the samples 47, 48, and 51 to 53.

The samples 49 and 50 both satisfied (K+L)/(M+N)≤0.82 and were evaluated as B in both the wear resistance test and the peeling resistance test. In the sample 49, however, the content ratio of Fe of the base material 19 was 0.001 mass % or more and 2 mass % or less, and 0.04≤X/Y<0.35 was satisfied. In the sample 50, the content ratio of Fe of the base material 19 was more than 2 mass % and less than or equal to 5 mass %, and X/Y≥0.35 was satisfied. Therefore, it was revealed that it was possible to ensure the wear resistance and the peeling resistance of the discharge member 20 by adjusting the content ratio of Fe of the base material 19 and X/Y.

In the samples 8 to 11, 20, 30, and 40, which were evaluated as A in both the wear resistance test and the peeling resistance test, the base material 19 contained 22 mass % or more and 28 mass % or less of Cr, 0.7 mass % or more and 1.3 mass % or less of Si, 0.6 mass % or more and 1.2 mass % or less of Al, 0.1 mass % or more and 1.1 mass % or less of Mn, 0.01 mass % or more and 0.07 mass % or less of C, and 0.001 mass % or more and 2 mass % or less of Fe, X/Y≥0.35 was satisfied, the area of the segregate was 0.01% or more and 4% or less, and (K+L)/(M+N)≤0.82 was satisfied.

According to the example, it was revealed that any of A to D was obtainable in the evaluation of the wear resistance test and the peeling resistance test by the base material 19 containing 50 mass % or more of Ni, 8 mass % or more and 40 mass % or less of Cr, 0.01 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 5 mass % or less of Fe while (K+L)/(M+N)≤1.14 being satisfied. In addition, it was revealed that any of A and B was obtainable in the evaluation in the peeling resistance test by (K+L)/(M+N)≤0.82 being satisfied.

The present invention has been described above on the basis of the embodiment. The present invention is, however, not limited by the aforementioned embodiment at all and easily assumed to be able to be variously improved or modified within the spirit of the present invention.

In the embodiment, a case in which the shape of the discharge member 20 is a disc shape has been described; however, the embodiment is not necessarily limited thereto, and it is naturally possible to employ another shape. Other shapes of the discharge member 20 are, for example, a frustum shape, an elliptic cylindrical shape, and prism shapes, such as a triangular prism shape and a quadrangular prism shape.

In the embodiment, a case in which the discharge member 20 is bonded to one end portion of the base material 19 and in which the other end portion of the base material 19 is connected to the metal shell 17 has been described; however, the embodiment is not necessarily limited thereto. It is naturally possible to interpose an intermediate material between the one end portion of the base material 19 and the discharge member 20. In this case, the intermediate material is a portion of the base material 19, and the discharge member 20 is bonded to the intermediate material (base material 19) with the diffusion layer 25 interposed therebetween.

In the embodiment, a case in which the elements of the P group consisting of Pt, Rh, Ir and Ru are contained in the discharge member 20 and in which the elements of the P group are not contained in the base material 19 has been described; however, the embodiment is not necessarily limited thereto. When concentration gradient of the P group is present between the base material 19 and the discharge member 20, diffusion of the P group occurs. Thus, it is obvious that, even when the base material 19 contains the elements of the P group, it is possible if the relation described in the embodiment is satisfied to suppress the discharge member 20 from peeling off and being worn out. When the base material 19 contains the elements of the P group, the atomic concentration L (at %) of the P group of the base material 19 has a value greater than 0.

In the embodiment, with the ground electrode 18 presented as an example of the first electrode, the diffusion layer 25 between the base material 19 of the ground electrode 18 and the discharge member 20 has been described; however, the embodiment is not necessarily limited thereto. It is naturally possible to use the center electrode 13 as the first electrode and the ground electrode 18 as the second electrode. In this case, the base material 14 of the center electrode 13 and the discharge member 15 are bonded to each other with the diffusion layer 25 interposed therebetween. As with the aforementioned embodiment, it is possible to suppress the discharge member 15 from peeling off from the base material 14 by making the composition of the base material 14 of the center electrode 13 similar to the composition of the base material 19 of the ground electrode 18.

In the embodiment, a case in which the diffusion layer 25 is formed between the base material 19 and the discharge member 20 by resistance welding has been described; however, the embodiment is not necessarily limited thereto. It is naturally possible to form the diffusion layer 25 by utilizing diffusion of atoms with the base material 19 and the discharge member 20 being in close contact with each other by a degree that minimize plastic deformation under a condition of a temperature less than or equal to the melting points of the base material 19 and the discharge member 20 and to thereby bond (commonly known as diffusion bonding) the base material 19 and the discharge member 20 to each other.

In the embodiment, a case in which the base material 19 bonded to the metal shell 17 is bent has been described. The embodiment is, however, not necessarily limited thereto. It is naturally possible to use a linear base material instead of using the bent base material 19. In this case, the linear base material is bonded to the metal shell 17 with the front-end side of the metal shell 17 extended in the axis O direction such that the base material faces the center electrode 13.

In the embodiment, a case in which the axis O of the center electrode 13 is in coincident with the center 23 of the discharge surface 21 of the discharge member 20 and in which the ground electrode 18 is disposed such that the discharge member 20 faces the center electrode 13 in the axial direction has been described. The embodiment is, however, not necessarily limited thereto, and the positional relation between the ground electrode 18 and the center electrode 13 can be set, as appropriate. Another positional relation between the ground electrode 18 and the center electrode 13 is, for example, an arrangement in which the ground electrode 18 is disposed such that a side surface of the center electrode 13 and the discharge member 20 of the ground electrode 18 face each other.

REFERENCE SIGNS LIST

10 spark plug
13 center electrode (second electrode)
18 ground electrode (first electrode)
19 base material
20 discharge member
22 spark gap
25 diffusion layer
27 segregate

The invention claimed is:

1. A spark plug comprising:

a first electrode including a base material and a discharge member having at least a portion thereof bonded to the base material with a diffusion layer interposed therebetween; and a second electrode facing the discharge member with a spark gap interposed therebetween, wherein the base material contains 50 mass % or more of Ni, 8 mass % or more and 40 mass % or less of Cr, 0.01 mass % or more and 2 mass % or less of Si, 0.01 mass % or more and 2 mass % or less of Al, 0.01 mass % or more and 2 mass % or less of Mn, 0.01 mass % or more and 0.1 mass % or less of C, and 0.001 mass % or more and 5 mass % or less of Fe, wherein the discharge member is an alloy containing Pt most and containing Ni, or the alloy further containing at least one of Rh, Ir, and Ru, and wherein, when Pt, Rh, Ir, and Ru are considered as a P group, K (at %) represents an atomic concentration of the P group of the discharge member, L (at %) represents an atomic concentration of the P group of the base material, M (at %) represents an atomic concentration of Ni of the discharge member, and N (at %) represents an atomic concentration of Ni of the base material, $(K+L)/(M+N) \leq 1.14$ is satisfied.

2. The spark plug according to claim 1, wherein the base material and the discharge member satisfy $(K+L)/(M+N) \leq 0.82$.

3. The spark plug according to claim 1, or claim 2, wherein, when X (mass %) represents a content ratio of Si of the base material and Y (mass %) represents a content ratio of Fe of the base material, $X/Y \geq 0.04$ is satisfied.

4. The spark plug according to claim 1, wherein, when X (mass %) represents a content ratio of Si of the base material and Y (mass %) represents a content ratio of Fe of the base material, $0.04 \leq X/Y \leq 1000$ is satisfied.

5. The spark plug according to claim 1, wherein, when X (mass %) represents a content ratio of Si of the base material and Y (mass %) represents a content ratio of Fe of the base material, $X/Y \geq 0.35$ is satisfied.

6. The spark plug according to claim 1, wherein the base material contains 0.001 mass % or more and 2 mass % or less of Fe.

7. The spark plug according to claim 1, wherein the base material contains 22 mass % or more and 28 mass % or less of Cr, 0.7 mass % or more and 1.3 mass % or less of Si, 0.6 mass % or more and 1.2 mass % or less of Al, 0.1 mass % or more and 1.1 mass % or less of Mn, 0.01 mass % or more and 0.07 mass % or less of C, and 0.001 mass % or more and 2 mass % or less of Fe.

8. The spark plug according to claim 1, wherein the base material includes a solid solution containing Ni, the solid solution including a segregate present therein, and wherein, in a cross-section of the base material, an area of the segregate occupying an area of the base material is 0.01% or more and 4% or less.

* * * * *